US005271575A

United States Patent [19]

Weinert

[11] Patent Number: 5,271,575

[45] Date of Patent: Dec. 21, 1993

[54] CORELESS PAPER ROLL MANUFACTURING SYSTEM

[75] Inventor: Lawrence E. Weinert, Antioch, Calif.

[73] Assignee: James River Paper Company, Inc., Richmond, Va.

[21] Appl. No.: 935,247

[22] Filed: Aug. 27, 1992

[51] Int. Cl.[5] ..... B65H 18/10

[52] U.S. Cl. ..... 242/67.1 R; 242/68.3; 242/81; 242/1

[58] Field of Search ..... 242/1, 68, 68.3, 68.5, 242/55, 81, 67.1 R; 29/406, 650

[56] References Cited

U.S. PATENT DOCUMENTS

| | | | |
|---|---|---|---|
| 494,600 | 4/1893 | Sharples . | |
| 1,577,326 | 3/1926 | Leon | 242/68.5 |
| 1,882,012 | 10/1932 | Hires . | |
| 1,927,197 | 9/1933 | Alderfer | 242/68 |
| 2,388,774 | 11/1945 | Tice | 242/68 X |
| 2,688,452 | 9/1954 | Higginbotham | 242/55.1 |
| 3,297,155 | 1/1967 | Gattenby, Jr. et al. | 242/68.5 |
| 3,847,366 | 1/1974 | Schmidt et al. | 242/68.3 |
| 3,853,279 | 12/1974 | Gerstein | 242/56.2 |
| 3,856,226 | 12/1974 | Dowd, Jr. | 242/56 R |
| 4,148,441 | 4/1979 | Cohen | 242/1 |
| 4,487,378 | 12/1984 | Kobayashi | 242/68 |
| 4,934,622 | 6/1990 | Hakiel | 242/1 X |

*Primary Examiner*—John M. Jillions
*Attorney, Agent, or Firm*—Thomas R. Lampe

[57] ABSTRACT

A system for forming coreless paper rolls having a center aperture of a predetermined cross-sectional configuration. The coreless paper roll is initially formed by winding a web about a first mandrel element having a first cross-sectional configuration and a distal end differing from the predetermined cross-sectional configuration. After the roll is formed it is slid over a second mandrel element having an outer surface with a second cross-sectional configuration to change the shape of the coreless paper roll center aperture from the first cross-sectional configuration to the predetermined cross-sectional configuration.

9 Claims, 1 Drawing Sheet

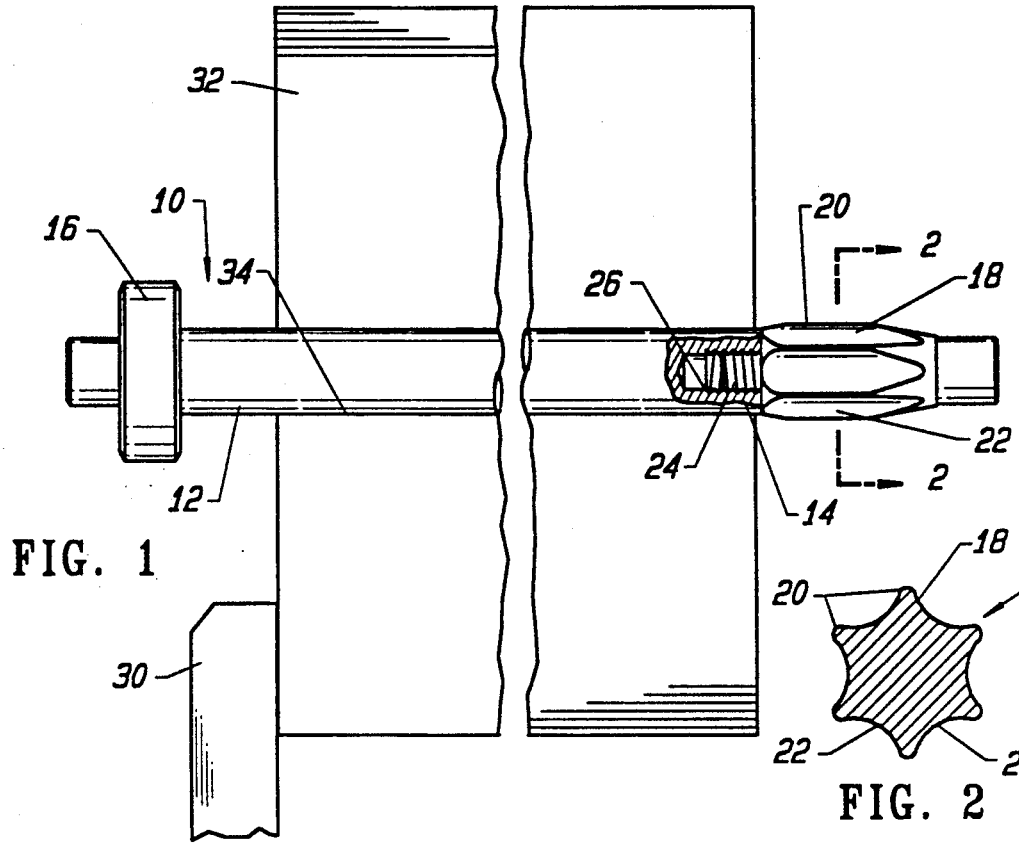
FIG. 1
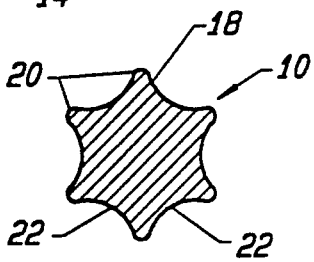
FIG. 2
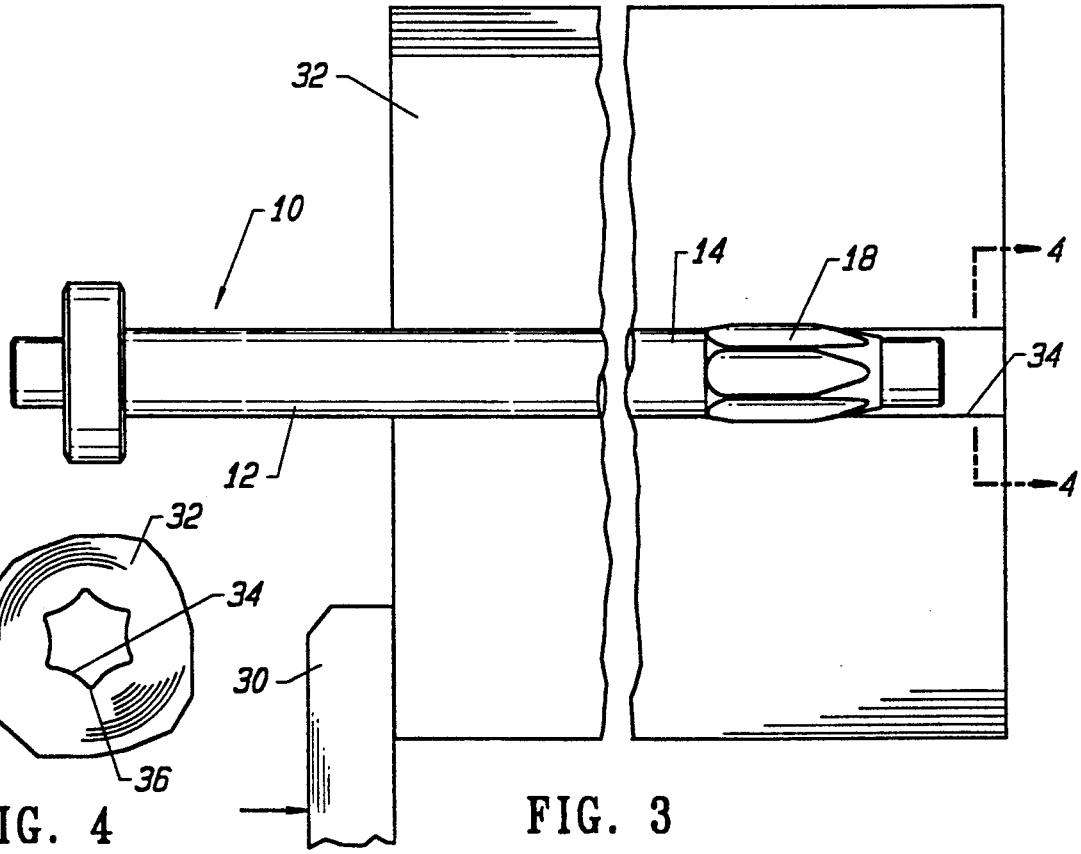
FIG. 4
FIG. 3

CORELESS PAPER ROLL MANUFACTURING SYSTEM

TECHNICAL FIELD

This invention relates to the manufacture of coreless paper roll products. More particularly, the invention concerns itself with mandrel apparatus for forming coreless paper rolls, such as toilet tissue rolls, having a center aperture of a predetermined cross-sectional configuration as well as a method of forming a coreless paper roll having a center aperture of a predetermined cross-sectional configuration.

BACKGROUND ART

It is well known to form coreless paper roll products such as rolls of toilet tissue on round mandrels. For example, U.S. Pat. No. 3,853,279, issued Dec. 10, 1974, and U.S. Pat. No. 3,856,226, issued Dec. 24, 1974, both disclose methods and apparatus wherein coreless rolls are formed by winding webs of tissue or other paper types directly about round winding mandrels.

U.S. Pat. No. 4,487,378, issued Dec. 11, 1984, discloses a coreless toilet paper roll having a center hole which is formed by winding toilet paper on a winding shaft having a polygonal or gear-shaped section and then extracting the polygonal or gear-shaped winding shaft from the roll. The special shafts which are employed when practicing the method of U.S. Pat. No. 4,487,378 are obviously quite expensive relative to round mandrels or winding shafts. Also, each specially constructed shaft can only form one specific aperture configuration.

Other patents of some relevance to the present invention of which applicant is aware are the following:

U.S. Pat. No. 1,882,012, issued Oct. 11, 1932, U.S. Pat. No. 1,577,326, issued Mar. 16, 1926, U.S. Pat. No. 1,927,197, issued Sep. 19, 1933, U.S. Pat. No. 494,600, issued Apr. 4, 1983, U.S. Pat. No. 2,688,452, issued Sep. 7, 1954, and U.S. Pat. No. 3,297,155, issued Jan. 10, 1967.

DISCLOSURE OF INVENTION

The present invention relates to a system of forming a coreless paper roll product such as a toilet tissue roll having a center aperture of a predetermined cross-sectional configuration. The apparatus of the invention is of relatively low cost and can be utilized to form a wide variety of aperture shapes, as desired by the manufacturer. This is accomplished without modifying in any way that portion of the mandrel about which the web is wound when forming a roll. Round mandrels are, of course, quite inexpensive to produce and the present invention may readily be carried out by initially winding a roll about such a round configuration.

The mandrel apparatus constructed in accordance with the teachings of the present invention is for forming coreless paper rolls having a center aperture of a predetermined cross-sectional configuration. The mandrel apparatus includes a first mandrel element comprising an elongated winding shaft having an axis of rotation, a distal end, and a first cross-sectional configuration differing from said predetermined cross-configuration. For example, the first cross-sectional configuration may be round.

The mandrel apparatus also includes a second mandrel element connected to the distal end of the first mandrel element. The second mandrel element has an outer surface with a second cross-sectional configuration differing from the first cross-sectional configuration and engageable with a formed coreless roll being stripped from the mandrel to change the shape of the coreless paper roll center aperture from the first cross-sectional configuration to the predetermined cross-sectional configuration.

Connector means, such as screw threads, are provided for releasably connecting the first and second mandrel elements. Utilizing this approach, a variety of second mandrel elements of differing cross-sectional configurations may be employed to provide a variety of predetermined cross-sectional configurations in the completed coreless paper roll product.

The present invention also encompasses a method of forming a coreless paper roll having a center aperture of a predetermined cross-sectional configuration. The method includes the step of winding a paper web about a rotating first mandrel element having a distal end and a first cross-sectional configuration differing from the predetermined cross-sectional configuration to form the coreless paper roll.

After the winding step, the coreless paper roll is stripped from the first mandrel element over the distal end. Simultaneously with the stripping step, a second mandrel element is passed through the center aperture of the coreless roll. The second mandrel element has an outer surface having a second cross-sectional configuration differing from the first cross-sectional configuration.

During the passing step, the shape of the inner wound layers of the coreless roll are modified to change the shape of the coreless roll center aperture from said first cross-sectional configuration to said predetermined cross-sectional configuration.

When practicing the method of the present invention, the shape of the inner wound layers of the coreless roll is modified gradually, with such modification beginning at one side of the coreless paper roll and gradually progressing to the other side of the coreless paper roll.

Other features, advantages, and objects of the present invention will become apparent with reference to the following description and accompanying drawings.

BRIEF DESCRIPTION OF DRAWINGS

FIG. 1 is a somewhat diagrammatic, elevational, frontal view illustrating a mandrel constructed in accordance with the teachings of the present invention and having a coreless roll of toilet tissue wound thereabout;

FIG. 2 is an enlarged, cross-sectional view taken along the line 2—2 of FIG. 1;

FIG. 3 is a view similar to FIG. 1, but illustrating the roll being stripped from the mandrel; and FIG. 4 is a partial, cross-sectional view taken along the line 4—4 of FIG. 3.

BEST MODE FOR CARRYING OUT THE INVENTION

Referring now to the drawings, mandrel apparatus constructed in accordance with the teachings of the present invention is designated generally by reference numeral 10. The mandrel includes a first mandrel element comprising an elongated winding shaft 12 having a distal end 14. For purposes of illustration, and as is conventional, the first mandrel element or winding shaft 12 has a round or circular cross-sectional configuration. Any suitable drive means may be employed to rotate the shaft 12 about its centrally disposed axis of rotation. For example, a pulley 16 may be affixed to the shaft 12 to provide means for rotating same.

Releasably connected to distal end 14 of shaft 12 is a second mandrel element 18. Element 18 includes a segment having the generally star-shaped cross-sectional configuration shown in FIG. 2 and defined by ribs 20 separated by ridges or channels 22. A threaded boss 24 projects from the generally star-shaped portion of the second mandrel element and is releasably threadedly engaged to threads defining a recess 26 at the distal end 14.

A pusher element 30 is utilized to strip coreless toilet tissue roll 32 from first mandrel element 12 over the distal end thereof after formation of the roll. Pusher element 30 may be movably mounted in any desired fashion. Alternatively, the winding shaft 12 itself may move relative to a fixed pusher element, or both the shaft and pusher element might be movably mounted. In any event, it is well known to strip a formed paper roll from a mandrel through a variety of expedients, and the particular means for doing so comprises no part of the present invention and will not be disclosed in detail.

As the roll 32 is stripped from the first mandrel element over the distal end thereof, the second mandrel element 18 passes through the center aperture 34. This will cause the aperture to generally assume the cross-sectional configuration of the second mandrel element. Of course, the final aperture cross-section, after passage of the second mandrel element therethrough, may not correspond exactly with the cross-section of the second mandrel element due to pressures and forces built up in the roll due to winding thereof as well as the resiliency of the paper material itself. Therefore, the cross-sectional configuration of the aperture 34 as shown in the completely stripped and removed roll 32 may have the general appearance shown in FIG. 4, for example. In any event, an aperture 34 through which a generally star-shaped second mandrel element has passed will tend to have longitudinally extending ridges where the ribs 20 have engaged the roll surrounding the aperture and modified the shape of the inner wound layers thereof.

If the inner layers or windings of the paper roll have been moistened in some manner prior to or during passage of the second mandrel element therethrough it will be appreciated that the cross-sectional configuration of aperture 34 will more closely conform to the cross-sectional configuration of the second mandrel element 18 than would otherwise be the case. This may occur, for example, when moisture has been applied to the initial roll convolutions or mandrel itself to initiate winding, a practice known in the prior art.

The cross-sectional configuration of second mandrel element 18 is but one of many cross-sectional configurations which might be employed. Changing the final cross-sectional configuration of aperture 34 of the coreless paper roll product would simply be a matter of replacing the illustrated second mandrel element 18 with one having another shape.

It is apparent from the above description that the method of forming a coreless paper roll having a center aperture of a predetermined cross-sectional configuration in accordance with the teachings of the present invention includes the step of winding a paper web about a rotating first mandrel element having a distal end and a first cross-sectional configuration differing from the predetermined cross-sectional configuration to form the coreless paper roll.

After the winding step, the coreless paper roll is stripped from the first mandrel element over the distal end.

Simultaneously with the stripping step, a second mandrel element is passed through the center aperture of the coreless roll, the second mandrel element having an outer surface with a second cross-sectional configuration differing from the first cross-sectional configuration.

During the passing step, the shape of the inner wound layers of the coreless paper roll are modified to change the shape of the coreless roll center aperture from the first cross-sectional configuration to the predetermined cross-sectional configuration.

The shape of the inner wound layers of the coreless roll is modified gradually, with such modification beginning at one side of the coreless paper roll and gradually progressing to the other side of the coreless paper roll.

The method also includes the step of attaching the second mandrel element to the distal end of the first mandrel element prior to the stripping step.

I claim:

1. Mandrel apparatus for forming coreless paper rolls having a center aperture of a predetermined cross-sectional configuration, said mandrel apparatus comprising, in combination:

a first mandrel element, said first mandrel element comprising an elongated winding shaft having an axis of rotation, a distal end, and a first cross-sectional configuration differing from said predetermined cross-sectional configuration; and a second mandrel element connected to the distal end of said first mandrel element, said second mandrel element having an outer surface with a second cross-sectional configuration differing from said first cross-sectional configuration and engageable with a formed coreless roll being stripped from said mandrel to change the shape of said coreless paper roll center aperture from said first cross-sectional configuration to said predetermined cross-sectional configuration.

2. The apparatus according to claim 1 additionally comprising connector means for releasably connecting said first and second mandrel elements.

3. The apparatus according to claim 1 wherein said first cross-sectional configuration is circular.

4. The apparatus according to claim 1 wherein said second cross-sectional configuration is generally star-shaped and defined by ribs separated by ridges.

5. The apparatus according to claim 1 wherein said connector means comprises mating threads formed on said first and second mandrel elements.

6. A method of forming a coreless paper roll having a center aperture of a predetermined cross-sectional configuration, said method comprising the steps of:

winding a paper web about a rotating first mandrel element having a distal end and a first cross-sectional configuration differing from said predetermined cross-sectional configuration to form said coreless paper roll;

after said winding step, stripping said coreless paper roll from said first mandrel element over said distal end;

simultaneously with said stripping step, passing a second mandrel element through the center aperture of said coreless roll, said second mandrel element having an outer surface with a second cross-sectional configuration differing from said first cross-sectional configuration; and during said passing step, modifying the shape of the inner wound layers of said coreless paper roll to change the shape of the coreless roll center aperture from said first cross-sectional configuration to said predetermined cross-sectional configuration.

7. The method according to claim 6 wherein the shape of the inner wound layers of said coreless paper roll is modified gradually, with such modification beginning at one side of the coreless paper roll and gradually progressing to the other side of said coreless paper roll.

8. The method according to claim 6 additionally including the step of attaching said second mandrel element to the distal end of said first mandrel element prior to said stripping step.

9. The method according to claim 6 wherein said second mandrel element during said stripping step forms longitudinally extending ridges in the coreless paper roll about said center aperture during said passing step.

* * * * *